US011981490B2

(12) United States Patent
Kelley et al.

(10) Patent No.: US 11,981,490 B2
(45) Date of Patent: May 14, 2024

(54) MOVING SYSTEM FOR CORES AND TUBES

(71) Applicant: Sonoco Development, Inc., Hartsville, SC (US)

(72) Inventors: Kevin Manly Kelley, Hartsville, SC (US); Neil Roland Davis, Asheboro, NC (US); David E. Rhodes, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 126 days.

(21) Appl. No.: 17/721,587

(22) Filed: Apr. 15, 2022

(65) Prior Publication Data

US 2023/0331451 A1 Oct. 19, 2023

(51) Int. Cl.

| | |
|---|---|
| ***B65D 71/00*** | (2006.01) |
| ***B65D 19/00*** | (2006.01) |
| ***B65D 19/42*** | (2006.01) |
| ***B65D 85/20*** | (2006.01) |

(52) U.S. Cl.

CPC ..... *B65D 71/0092* (2013.01); *B65D 19/0095* (2013.01); *B65D 19/42* (2013.01); *B65D 85/20* (2013.01); *B65D 2519/00781* (2013.01)

(58) Field of Classification Search

CPC ..... B65D 71/0092; B65D 19/0095; B65D 19/42; B65D 85/20; B65D 2519/00781

USPC ..... 108/55.1

See application file for complete search history.

(56) References Cited

U.S. PATENT DOCUMENTS 2,798,600 A * 7/1957 O'Konski ..... B65D 85/62 206/83.5
2,860,772 A * 11/1958 Northington, Jr. .... B65D 71/04 206/321
3,077,982 A * 2/1963 Berner ..... B65D 71/0092 206/600
3,097,741 A * 7/1963 Schwartz ..... B65D 71/02 206/499
3,288,311 A * 11/1966 Beattie ..... B65D 61/00 280/145
3,645,559 A * 2/1972 Stafford, Jr. ..... B62D 53/065 414/458
3,729,215 A * 4/1973 Paakkinen ..... B62D 53/065 280/441.2
3,853,238 A 12/1974 Luisada et al.
4,148,394 A * 4/1979 Bederman ..... B65D 71/0092 206/599

(Continued)

FOREIGN PATENT DOCUMENTS

DE 10220746 A1 * 11/2003 ..... B65D 88/129
EP 2108563 B1 4/2014

OTHER PUBLICATIONS

International Search Report and Written Opinion related to Application No. PCT/US2023/016657; reported on Jul. 13, 2023.

*Primary Examiner* — Jose V Chen

(74) *Attorney, Agent, or Firm* — von Briesen & Roper, s.c.

(57) ABSTRACT

A system for moving and transporting cargo, such as bundled cores and tubes, that doesn't require wheeled carts. The system may comprise a forklift truck, a front engagement device connecting the cargo to the forklift truck, a rear roller unit, and one or more spaced apart bottom supports. When the forklift forks are in the raised position, the cargo front (leading) end is tilted above the cargo rear (trailing) end and the bottom supports are disengaged from the floor, allowing the cargo to be moved.

16 Claims, 10 Drawing Sheets

(56) References Cited

U.S. PATENT DOCUMENTS 4,213,624 A * 7/1980 Sanders ..... B65D 19/42 280/43.12
4,317,517 A * 3/1982 Tisdale ..... B65D 71/0092 206/599
4,834,000 A * 5/1989 Darnell ..... B65D 19/42 108/55.1
5,161,933 A * 11/1992 Stauber ..... B65H 49/38 280/43.12
5,355,813 A * 10/1994 Darnell ..... B65D 19/44 108/55.3
5,562,392 A 10/1996 Raben
5,582,114 A * 12/1996 Feiner ..... B65D 19/0034 280/304.5
6,168,222 B1 * 1/2001 Lacy, III ..... B66C 1/14 53/399
6,637,351 B1 * 10/2003 Brennan, Jr. ..... B65D 19/0026 108/54.1
6,694,894 B1 * 2/2004 Darnell ..... B65D 88/129 108/57.17
8,690,514 B2 * 4/2014 Marola ..... B60P 3/125 280/402
8,925,470 B2 * 1/2015 Hart ..... B65D 71/0092 108/55.1
2002/0031418 A1 * 3/2002 Hagenzieker ..... B65D 90/00 414/139.4
2003/0205907 A1 * 11/2003 Casteran ..... B65D 85/20 294/67.3
2005/0108989 A1 * 5/2005 Dickner ..... B65B 13/181 53/445
2007/0053760 A1 * 3/2007 Bohac ..... B61D 45/00 410/42
2007/0264109 A1 11/2007 Curtis et al.
2012/0047853 A1 * 3/2012 Harkonen ..... B32B 5/022 53/461
2014/0027395 A1 * 1/2014 Benoit ..... B65D 88/129 211/70.4
2016/0332554 A1 11/2016 Ambrosio et al.
2017/0129691 A1 * 5/2017 Power ..... B60P 7/12
2017/0174403 A1 * 6/2017 Feudner ..... B65D 85/62
2020/0223584 A1 * 7/2020 Tripp ..... B65D 19/06
2021/0214193 A1 * 7/2021 Gray ..... B66C 1/101
2021/0269229 A1 * 9/2021 Sparschuh ..... B65D 71/02

* cited by examiner

MOVING SYSTEM FOR CORES AND TUBES

FIELD OF THE INVENTION

This disclosure relates to a system for moving and transporting cargo. More particularly, this disclosure relates to a system for moving and transporting bundled cores and tubes that doesn't require wheeled carts.

DESCRIPTION OF THE RELATED ART

Cores and tubes, terms that sometimes are used interchangeably, may be used for carrying wound materials such as sheet or strand materials. Cores generally are elongated hollow cylindrical structures made of paper or plastic. After being manufactured by the core manufacturer, the cores must be transported, typically on trailers, to a separate facility where either strand or sheet material is wound thereon.

Carts traditionally are used in the United States to move the cores. At some core making facilities, almost all truck trailers are loaded from the rear, so the carts must have casters so they can be rolled into the trailer from a loading dock. Once fully loaded, the trailer transports the cores, still carried on a cart, to a separate facility, such as a paper manufacturing facility. Carts have been found useful in transporting longer cores that can't be easily handled with a fork lift truck due to the cantilever effect.

While carts are suitable for handling longer cores, they come with drawbacks. Carts are expensive to purchase upfront, have a significant maintenance cost associated with them, and require return freight from a customer to get them back in order to be reused. Furthermore, carts take up space in the core making plant, or require trailer leases for storage onsite.

The present disclosure is designed to solve the problems described above.

BRIEF SUMMARY OF THE INVENTION

The present disclosure relates to a system for moving and transporting cargo that doesn't require wheeled carts. The cargo may be cores and tubes (a.k.a. "cargo units") stacked in an array and bundled together.

In one embodiment the system may comprise a hauler, a front engagement device, a rear roller unit and one or more spaced apart pallets. The cargo has an underside, a front (leading) end, a rear (trailing) end. The hauler may be a forklift truck comprising an operator cab and a hitching element reciprocally moveable in a vertical direction between a lower position and a raised position. The front engagement device may be affixed to the underside of the cargo and slightly rearward of the cargo front end to reduce load on the cargo front end. The front engagement device is configured to be operably engaged to the hitching element. The rear roller unit may be affixed to the underside of the cargo slightly forward of the cargo rear end to allow raising of the cargo front end without damaging the cargo. The rear roller unit may comprise a rear frame attached to the cargo and one or more rollers. The pallets may be affixed in stationary relationship to the underside of the cargo.

When the hitching element engages the front engagement device and is in the lower (stationary) position, each of the pallets contacts the ground. When the hitching element engages the front engagement device and is in the raised position, the cargo front end is elevated above the cargo rear end, the front engagement device and the pallets are disengaged (spaced) from the floor, and the one or more rollers are in rolling contact with the floor, thereby allowing the cargo to be easily moved.

In a refinement, the cargo comprises multiple elongated cargo units bundled together in tight, staggered arrays of at least three layers and held together with straps. Each cargo unit may be a paperboard or plastic hollow cylindrical tube or core.

Each pallet may define openings extending laterally across a width of the pallet to accommodate the straps extending therethrough. The straps may extend over and around the cargo to secure the cargo to the pallets.

In another refinement, one or more of the pallets includes a runner having a tapered front end and a tapered rear (trailing) end to prevent the pallets from catching on or being jostled by irregularities on or part of the ground.

The front engagement device may be a U-shaped member defining a lateral channel for accommodating one or more straps. The front engagement device may have a forward facing wall that defines an opening for accommodating a linkage system for connecting the front engagement device to the hauler. The front engagement device may be pivotally connected to the forklift truck via the linkage system. The linkage system may comprise a pair of channel members configured to receive the forks, a crossmember affixed to a distal end (located away from the forklift truck) of each channel member in stationary relationship therewith, a hitch arm connected to the crossmember, and a hitching bar pivotally connected to the hitch arm at a pivot point. The hitching bar extends rearwardly into the opening defined by in the front engagement device.

In another refinement, the system may further comprising at least one cargo side support system, the cargo side support system comprising a U-shaped member defining a channel and having two ends, a pair of hinges affixed to each U-shaped member end, two cargo side supports, each cargo side support extending upwardly from an end of the U-shaped member to support a side of the cargo, and one or more straps extending through the channel, along an outer surface of each cargo side support and around the cargo.

In another embodiment the system may comprise a hauler, a front engagement device, a rear roller unit and one or more spaced apart blocks. The hauler (such as a forklift truck) comprises an operator cab and a hitching element reciprocally moveable in a vertical direction between a lower position and a raised position. The front engagement device may be affixed to the underside of the cargo and slightly rearward of the cargo front end to reduce load on the cargo front end, the front engagement device configured to be operably engaged to the hitching element. The rear roller unit may be affixed to the underside of the cargo slightly forward of the cargo rear end to allow raising of the cargo front end without damaging the cargo, the rear roller unit comprising a rear frame and one or more rollers affixed to the rear frame. The one or more spaced apart blocks may be affixed in stationary relationship to the underside of the cargo and configured to contact the ground when the hitching element is in the lower position. Each block has a height extending from the cargo underside to the ground when the when the hitching element is in the lower position.

When the hitching element engages the front engagement device and is in the lower position, each of the blocks contacts the ground. When the hitching element engages the front engagement device and is in the raised position, the cargo front end is elevated above the cargo rear end, the front engagement device and the blocks are disengaged (spaced) from the floor, and the one or more rollers are in rolling contact with the floor, thereby allowing the cargo to be easily moved.

Each block may be an elongated rectilinear block-shaped structure. Each block may have a height (BH) equal to the distance from the underside of the cargo to the ground when the hitching element is in the lowered position, wherein the width (BW) of the block exceeds the height (BH) of the block. The bottom side of each block may define a lateral groove for accommodating a strap.

The front engagement device may be a stand-alone unit and may comprise a frame and a hitching bar extending from the frame forward of the cargo front end, wherein the hitching bar is pivotally connected to the hauler.

DETAILED DESCRIPTION OF THE INVENTION

Figure 1:
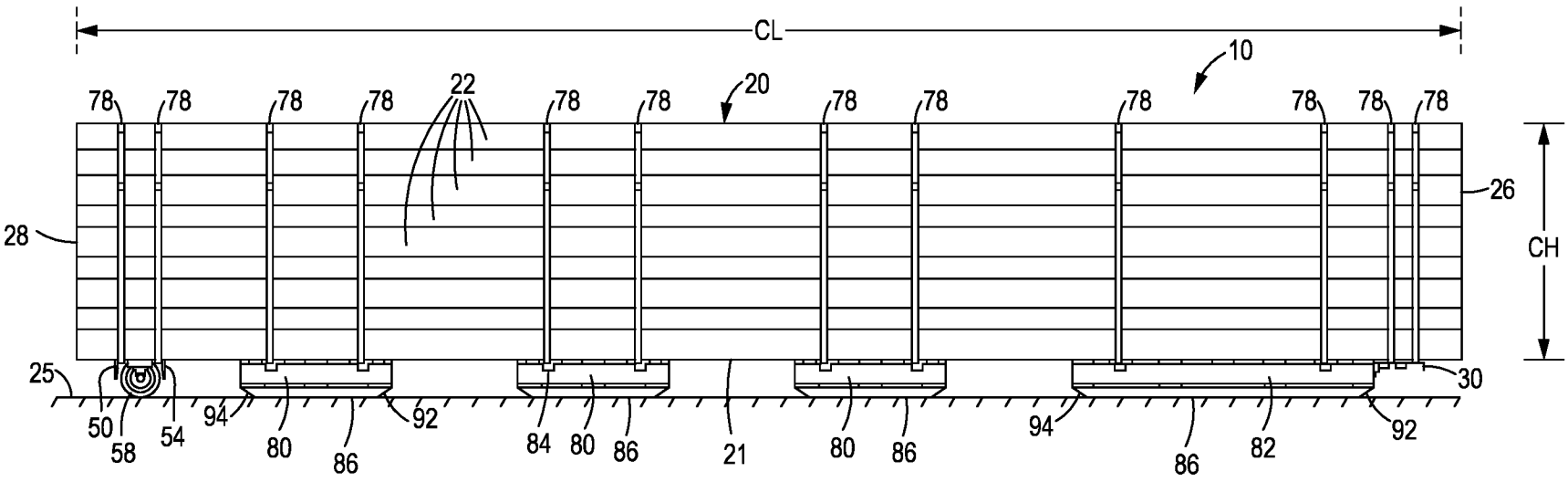
FIG. 1 is a side elevational view of a preferred system for moving cargo, comprising a plurality of pallets supporting an array of bundled cores, a front engagement device and a rear roller unit.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "above", "top", "bottom", "underside", "front" and "rear," (etc.), used as nouns, adjectives or adverbs, refer in this description to the orientation of the structure of the cargo moving system as it is illustrated in the various views. Such terms are not intended to limit the invention to a particular orientation. The terms "floor", "ground" and "surface" are used interchangeably to refer to any surface over which the cores and tubes are moved.

The present disclosure relates to a system for moving and transporting cargo that doesn't require wheeled carts. The cargo may be elongated units such as paper or plastic cores and tubes (a.k.a. "cargo units") stacked in an array and bundled together. In general, the system may comprise a front engagement device, a rear roller unit and one or more spaced bottom supports. The system may be moved using hauler such as a forklift truck having a pair of forks that are reciprocally moveable in a vertical direction between a lower position and a raised position. The front engagement device is configured to be operably engaged to the hitching element. The rear roller unit may comprise a rear frame attached to the cargo and one or more rollers. The bottom supports may be affixed in stationary relationship to the underside of the cargo and may be pallets, blocks, or a combination of pallets, blocks and any other structures suitable for supporting the cargo.

When the hitching element engages the front engagement device and is in the lower (stationary) position, each of the bottom supports contacts the ground. When the hitching element engages the front engagement device and is in the raised position, the cargo front end is elevated above the cargo rear end, the front engagement device and the bottom supports are disengaged (spaced) from the floor, and the one or more rollers are in rolling contact with the floor, thereby allowing the cargo to be easily moved.

I. System 10—FIG. 1 (Preferred Embodiment)

Turning to the figure, FIG. 1 shows a preferred system 10 for moving cargo 20 across a surface 25. The system 10 comprises a front engagement device 30, a rear roller unit 50, straps or bands 78 and multiple pallets 80, 82. The system 10 can move an array of bundled cores 22 being held together by straps 78 and supported above the floor 25 by the pallets 80, 82. The system 10 enables moving and transporting the cargo 20 without the need for wheeled carts.

Figure 2:
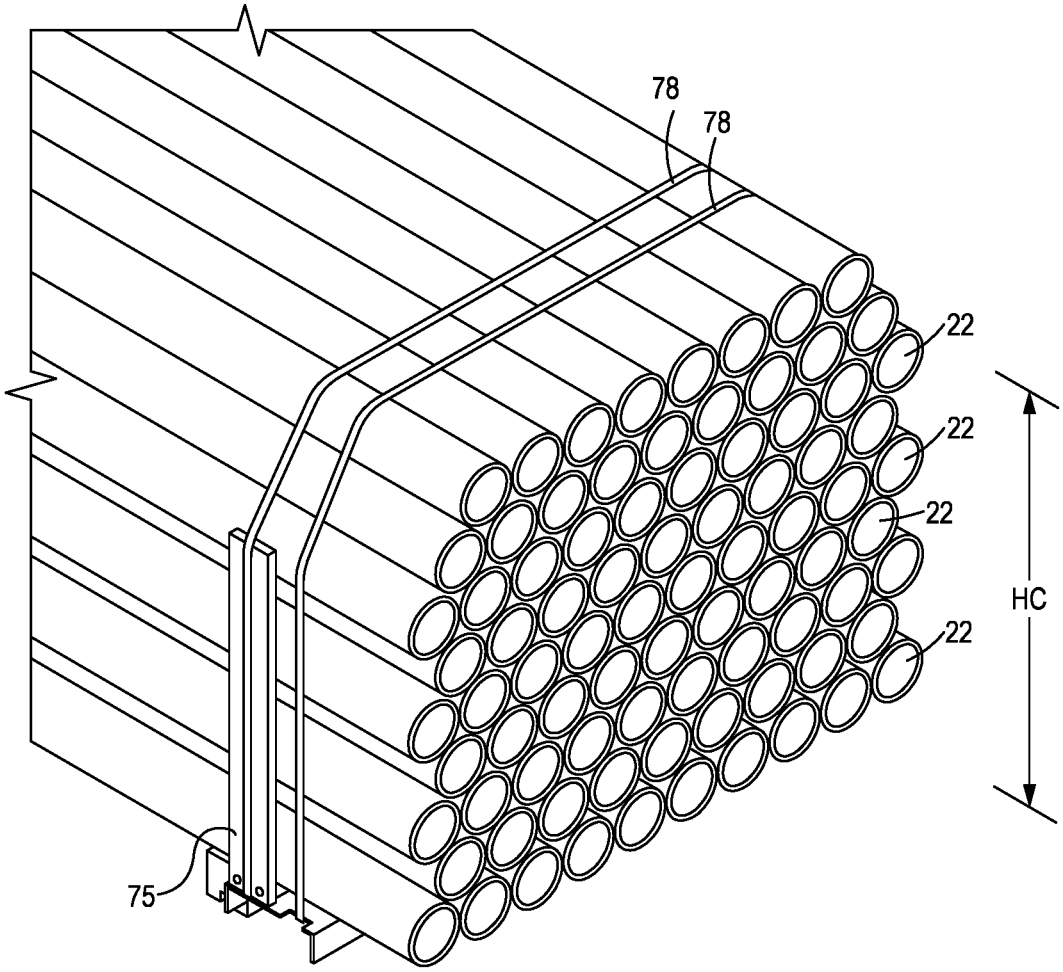
FIG. 2 is a partial top perspective view of an array of bundled cores being held together with straps and including an optional cargo side support system.

Cargo 20—FIG. 2

The cargo 20 may have an underside 21, a front (leading or forklift facing) end 26, a rear (trailing) end 28, a longitudinal cargo length (CL) and a cargo height (CH). Each core 22 may be a hollow cylindrical paperboard tube of the kind used for winding sheet material such as textiles.

Preferably the cores 22 are stacked in tight, staggered arrays of at least three layers and held together by straps 78 as best shown in FIG. 2. The straps 78 may be tensioned so as to minimize deformation of the tubes 22. FIG. 2 also shows optional cargo side supports 75, the purpose of which is explained further below.

Pallets 80, 82

The cargo 20 is supported by a plurality of longitudinally spaced apart pallets 80, 82, such as half pallets 80 and/or full pallets 82. Each pallet 80, 82 may define openings 84 extending laterally across the entire width of the pallet to accommodate straps 78 extending therethrough. The straps 78 extend over and around the cargo 20, such as an array of cores 22, to secure the cargo 20 to the pallets 80, 82.

Preferably the pallets 80, 82 include runners 86 attached to or part of the underside (bottom) of each pallet 80, 82, each runner 86 having a tapered front end 92 and a tapered rear (trailing) end 94 to prevent the pallets 80, 82 from catching on or being jostled by irregularities on or part of the floor 25. Each runner 86 may be affixed to the bottom of a pallet 80, 82. Alternatively, instead of runners 86, each pallet 80, 82 may have its own tapered front (leading) end and/or a tapered rear (trailing) end.

In another alternative described below, the cargo 20 may be supported by a combination of blocks 60 and/or one or more pallets 80, 82.

Front Engagement Device 30

The front engagement device 30 is attached to the cargo 20 near the cargo front end 26 and is configured to operably engage a hitching element such as hitching forks 17. Preferably, the front engagement device 30 is also affixed to the front pallet 82 to provide more stiffness to the system 10.

The front engagement device 30 may be any suitable configuration. For example, the front engagement device 30 may be a U-shaped structure defining a lateral channel 72 for accommodating one or more straps 78. The front engagement device 30 has a forward facing wall 37 that defines an opening 39 for accommodating a linkage system 40 for connecting the front engagement device 30 to a hauler 12 such as a forklift truck.

Figure 4:
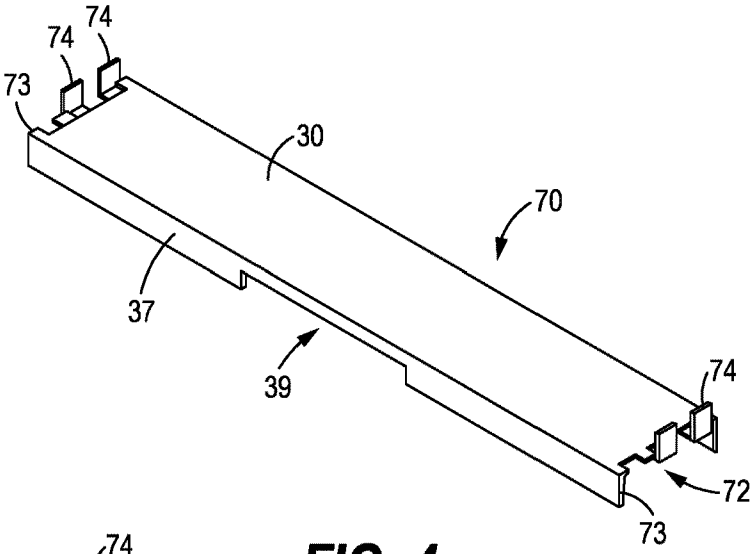
FIG. 4 is a top perspective view of the front engagement device of FIG. 3.
Figure 5:
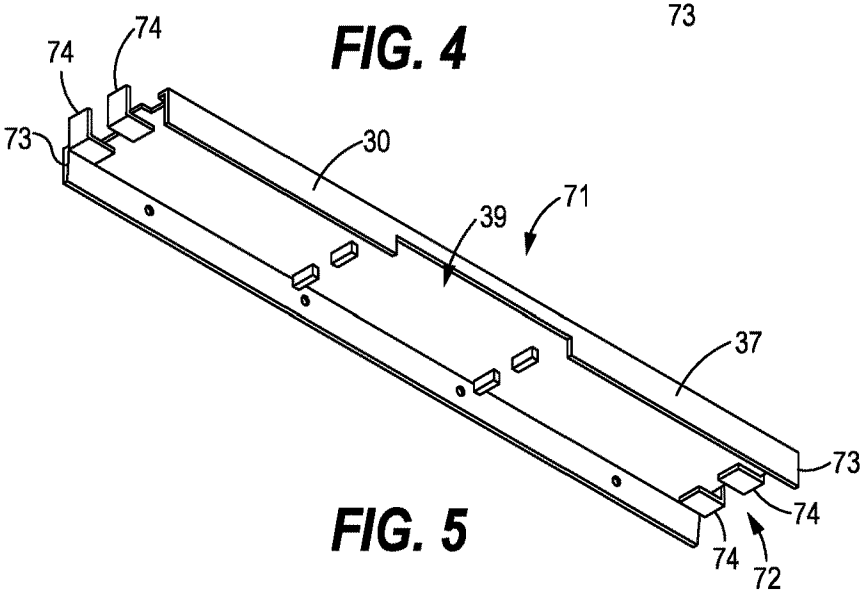
FIG. 5 is a bottom perspective view of the front engagement device of FIG. 4.
Figure 3:
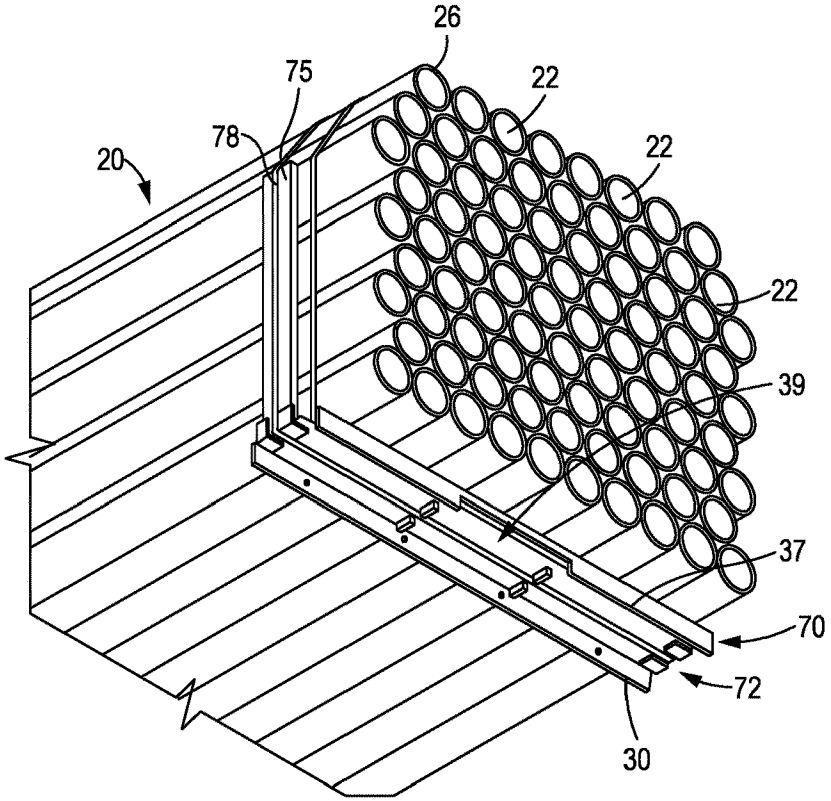
FIG. 3 is a partial bottom perspective view of the array of bundled cores of FIG. 2, including a front engagement device.

FIG. 3 is a partial bottom perspective view of a front engagement device 30 attached to the underside of an array of bundled cores 22 near the cargo front end 26. FIG. 4 is a top perspective view of the front engagement device 30 of FIG. 3. FIG. 5 is a bottom perspective view of the front engagement device 30 of FIG. 4.

Referring to FIG. 3, the front engagement device 30 may be a component of a cargo side support system 70, a plurality of which may be located along the cargo length (CL) for holding the cargo units 22 together. Each cargo side support system 70 may comprise a U-shaped member 71 (such as the front engagement device 30 shown in FIGS. 3-5), the U-shaped member 71 defining a channel 72 and having two ends 73, a pair of hinges 74 affixed to each U-shaped member end 73, and two rigid cargo side supports 75. Each cargo side support 75 extends upwardly from an end 73 of the U-shaped member 71 to support a side of the cargo 20. Each cargo side support 75 preferably has a width (in the front to rear direction) of at least six inches to minimize twisting of the cargo 20 and a height less than the height (HC) of the cargo 20. One or more straps 78 extend between each pair of hinges 74, through the U-shaped member channel 72, along an outer surface of each cargo side support 75, and around the cargo 20.

In an alternative embodiment shown in FIG. 14 and described in more detail below, the front engagement device 130 is a stand-alone unit comprising a frame 131 and a hitching bar 138 extending forward of the cargo front end 26.

Figure 6:
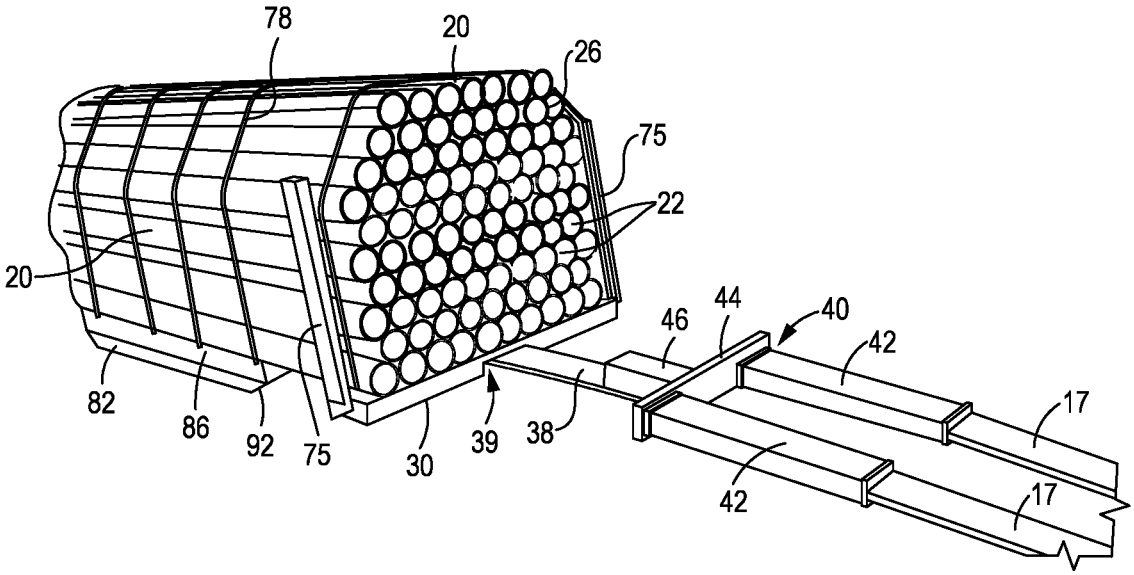
FIG. 6 is a partial perspective view of a system for moving cargo, showing a system for linking the cargo to a forklift truck.
Figure 7:
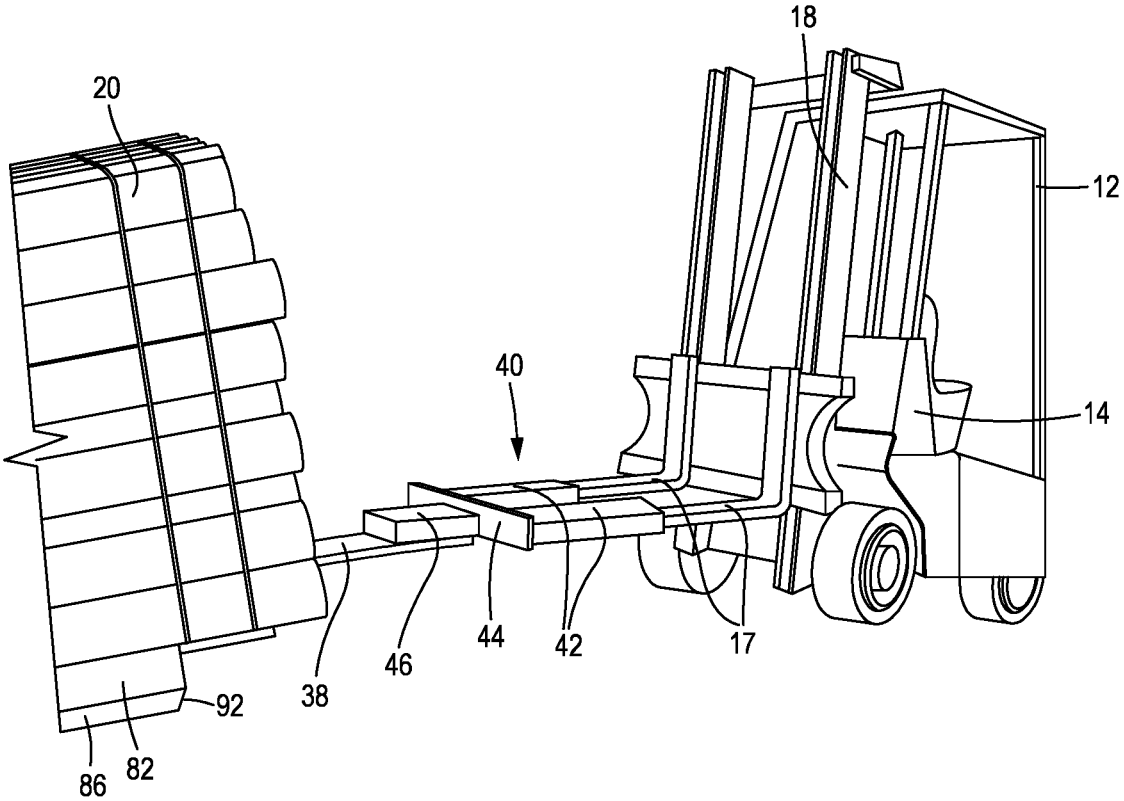
FIG. 7 is a different perspective view of the system for moving cargo of FIG. 6.

Linkage system 40—FIGS. 6 and 7

The front engagement device 30, and thus the cargo 20, may be pivotally connected to a forklift truck 12 via any suitable means. For example, as shown in FIGS. 6 and 7, the front engagement device 30 may be pivotally connected to the forklift truck 12 via a linkage system 40. The linkage system 40 may comprise a pair of channel members 42 configured to receive the forks 17, a crossmember 44 affixed to a distal end (located away from the forklift truck 12) of each channel member 42 in stationary relationship therewith, a hitch arm 46 connected to the crossmember 44, and a hitching bar 38 pivotally connected to the hitch arm 46 at a pivot point. The hitching bar 38 extends rearwardly into the opening 39 in the front engagement device 30. The linkage system 40 may further comprise means for preventing the forks 17 from disengaging from the channel members 42, and additional means for preventing the hitching bar 38 from disengaging from the front engagement device 30.

Rear Roller Unit 50

The rear roller unit 50 is affixed to the underside of the cargo 20 slightly forward of the cargo rear end 28 and is configured to allow tilting of the cargo 20 (by lifting the front end 26) without damaging the cargo units 22, particularly the cargo units 22 located on the bottom of the array closest to the floor 25.

Figure 8:
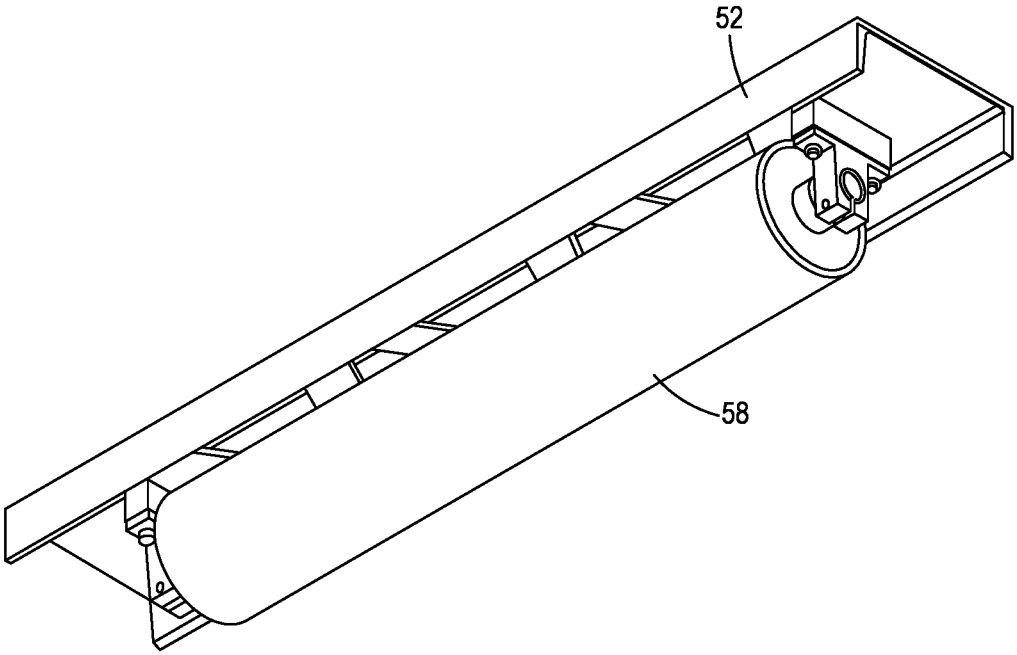
FIG. 8 is a bottom perspective view of a first embodiment of a rear roller unit for use with the core moving system according to the present disclosure.
Figure 9:
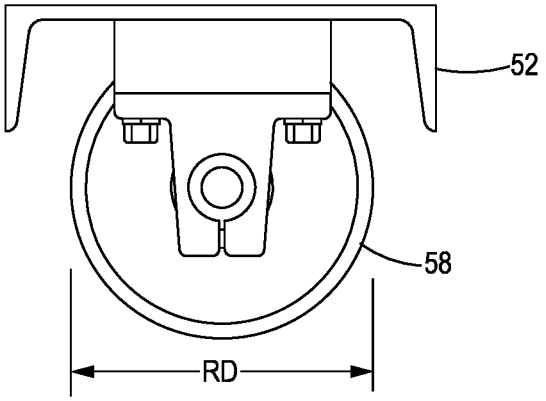
FIG. 9 is a side elevational view of the rear roller unit of FIG. 8.

The rear roller unit 50 may by any suitable configuration that allows controlled movement of the cargo 20 across a floor or other surface 25. For example, in one embodiment shown in FIGS. 8 and 9, the rear roller unit 50 comprises a U-shaped rear frame 52 and a single roller or wheel 58 affixed to the rear frame 52 and oriented perpendicularly to the cargo length (CL). The roller 58 has a roller diameter (RD). As shown in FIG. 1 one or more straps 78 may secure the rear roller unit 50 to the cargo 20.

Figure 10:
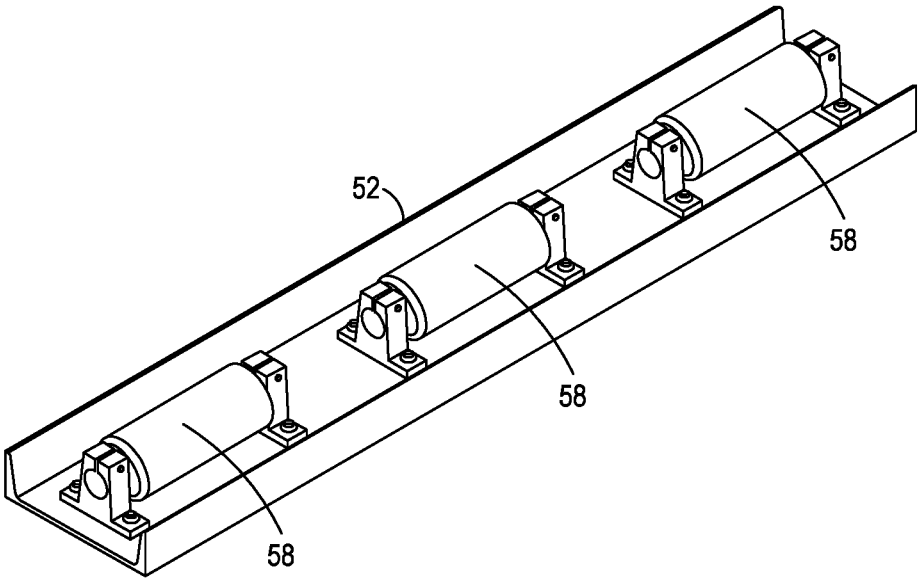
FIG. 10 is a bottom perspective view of a second embodiment of a rear roller unit for use with the core moving system according to the present disclosure.
Figure 11:
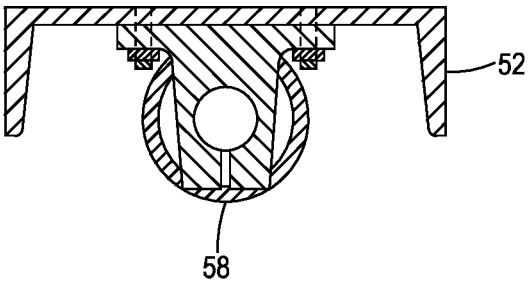
FIG. 11 is a side elevational view of the rear roller unit of FIG. 10.

In another embodiment shown in FIGS. 10 and 11, the rear roller unit 50 comprises a rear frame 52 and multiple axially (laterally) aligned rollers or wheels 58 affixed to the rear frame 52 and oriented perpendicularly to the cargo length (CL).

Figure 12:
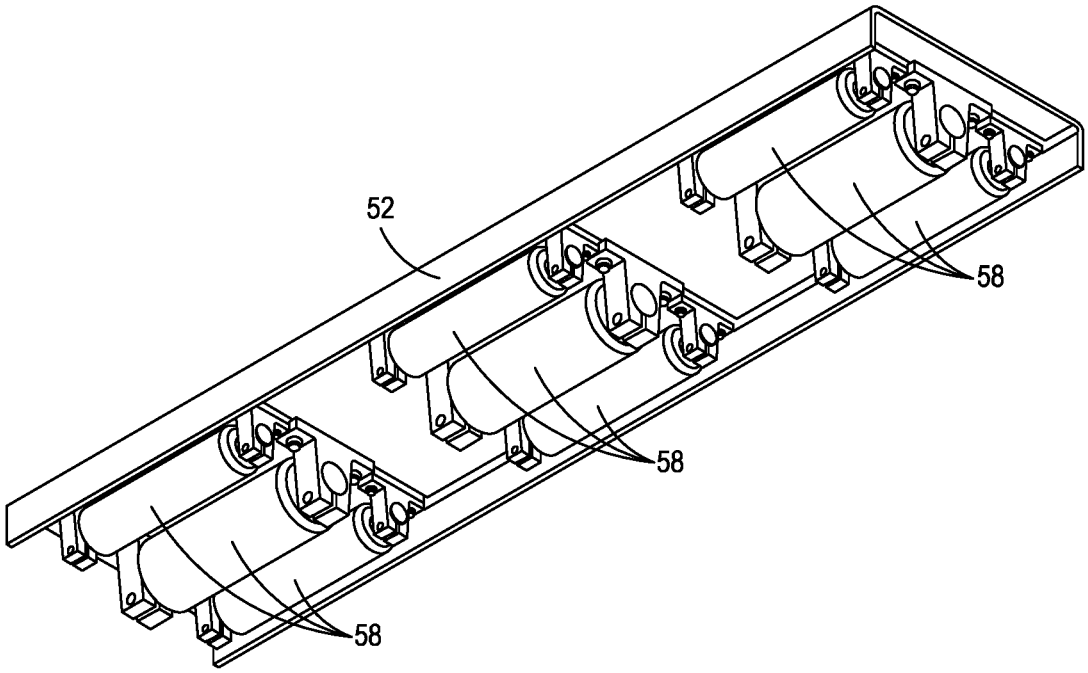
FIG. 12 is a bottom perspective view of a third embodiment of a rear roller unit for use with the core moving system according to the present disclosure.
Figure 13:
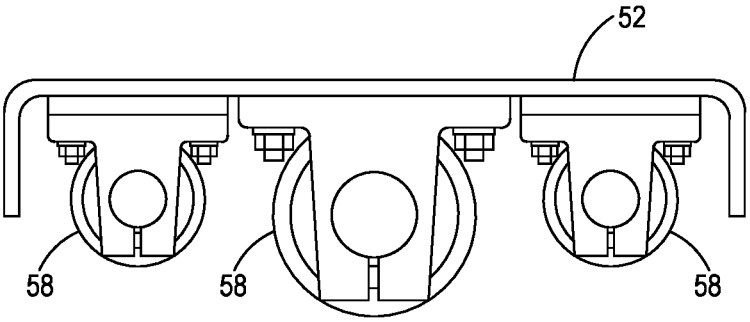
FIG. 13 is a side elevational view of the rear roller unit of FIG. 12.

In still another embodiment shown in FIGS. 12 and 13, the rear roller unit 50 comprises a rear frame 52 and multiple rows of axially aligned rollers or wheels 58 affixed to the rear frame 52 and oriented perpendicularly to the cargo length (CL).

In any of these embodiments, when the hitching element engages the front engagement device 30 and is in the lower position, the pallets 80, 82 (or the blocks 60 described below) contact the surface 25 and inhibit movement of the cargo 20. But when the hitching element 16 engages the front engagement device 30 and is in the raised position, the cargo front end 26 is elevated above the cargo rear end 28 and each of the pallets 80, 82 (or blocks 60) is elevated off (spaced apart from) the surface 25, allowing rolling movement of the cargo 20.

Alternatively, the system 10 may lack a rear roller unit 50. Instead, a rear mounted pallet (similar to the pallets 80, 82 shown in FIG. 1) may be used to support the rear end 28 of the cargo 20. Such an embodiment would be best suited for simple forward and backward movement. When the hitching element 16 engages the front engagement device 30 and is in the lower position, the pallets 80, 82 contact the surface 25 and inhibit easy movement of the cargo 20. When the hitching element 16 engages the front engagement device 30 and is in the raised position, the cargo front end 26 is elevated above the cargo rear end 28 and each of the pallets 80, 82 except the rearmost pallet 80, 82 is spaced apart from the surface 25, allowing sliding movement of the cargo 20.

II. System 100—FIGS. 14-16 (Alternative Embodiment)

Figure 14:
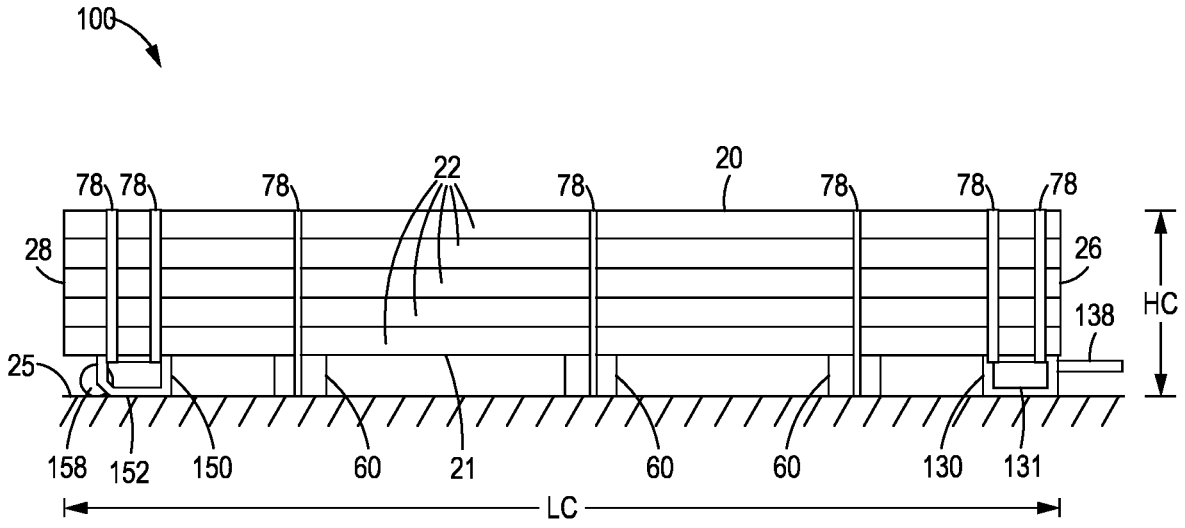
FIG. 14 a side elevational view of a alternative system for moving cargo, comprising an array of bundled cores supported above the ground by blocks, a front engagement device and a rear roller unit.
Figure 15:
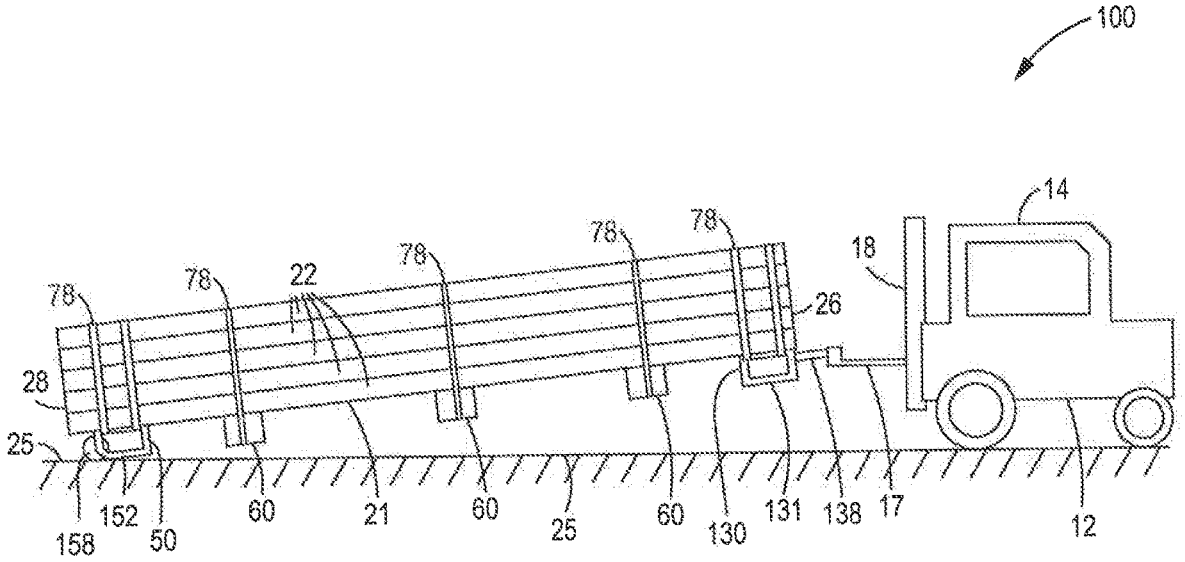
FIG. 15 is side elevational view of a core moving system according to the present disclosure, shown in the raised (moving) position.
Figure 16:
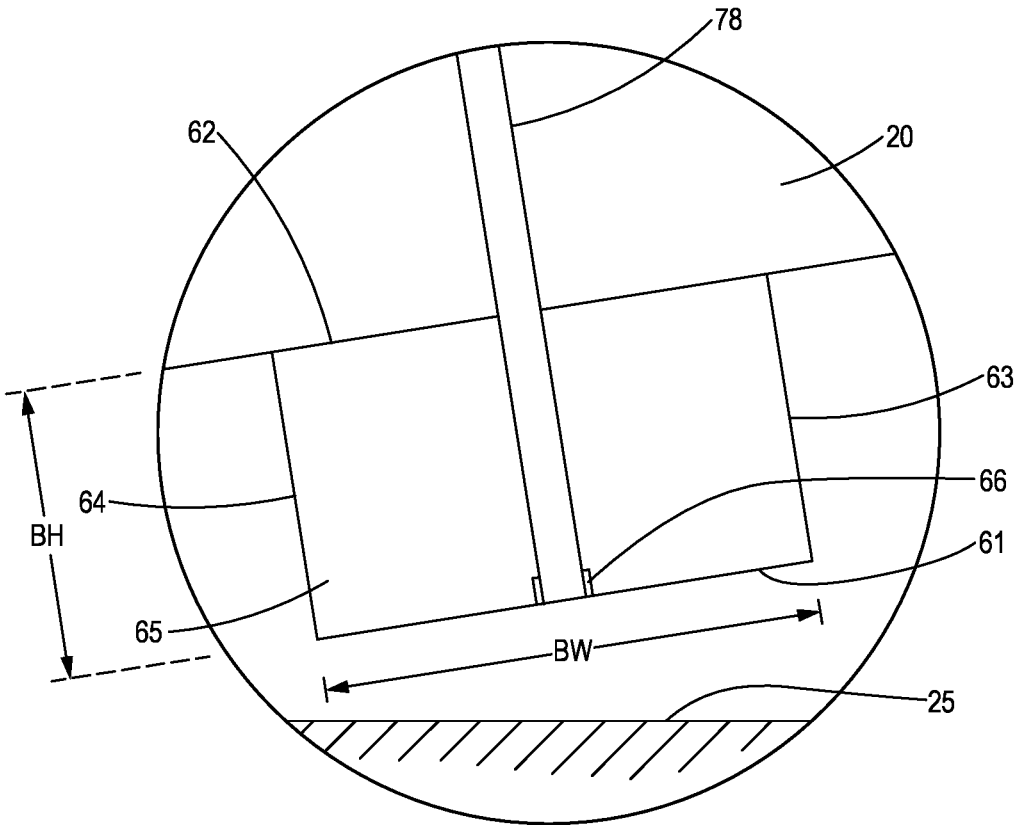
FIG. 16 is an enlarged side elevational view of one of the blocks of FIG. 15.

In another embodiment shown in FIGS. 14 to 16, the system 100 comprises a front engagement device 130, a rear roller unit 150, multiple blocks 60 and straps or bands 78.

The cargo 20 rests on and may be affixed to the blocks 60 and, optionally, the front engagement device 130 and/or rear roller unit 150 as well. As previously described, the cargo 20 may comprise an array of elongated items such as hollow cylindrical tunes or cores, referred to as cargo units 22. The cargo units 22 may be bundled together with straps or bands 78.

Front Engagement Device 130

As in the previous embodiment, the front engagement device 130 is configured to operably engage a hitching element such as hitching forks 17 and may be any suitable configuration. In the embodiment shown in FIG. 14 the front engagement device 130 a stand-alone unit (meaning that it is not directly attached to a block 60) and comprises a box-shaped frame 131 and a hitching bar 138. The hitching bar 138 extends from the frame 131 forward of the cargo front end 26 and may be pivotally connected to a forklift truck 12 or other hauling means. For example, the hitching bar 138 may attach to vertical extensions of the forks 17.

Blocks 60

The blocks 60 can be any suitable configuration. For example, each of the blocks 60 may be an elongated rectilinear block-shaped structure such as those shown in FIGS. 14-16. Each of the one or more blocks 60 is affixed in stationary relationship to the underside of the cargo 20 and configured to contact the floor 25 when the hitching element or forks 17 are in the lower position. The blocks 60 preferably are spaced apart in the longitudinal direction (direction of travel).

FIG. 16 is an enlarged side elevational view of one of the blocks 60 of FIG. 14. The rectilinear block 60 has a bottom side 61, a top 62, a front side 63, a rear side 64 and two lateral ends 65. Each block 60 may have a height (BH) (extending from the top 62 to the bottom side 61) equal to the distance from the underside of the cargo 20 to the floor 25 when the hitching element 16 is in the lowered position. Each block 60 also has a length (extending laterally from one end 65 to the other end 65), and a width (BW) (measured as the distance between the front side 63 and the rear side 64) of sufficient dimension to minimize bending stress on the cargo 20. In one embodiment, for example, for a 6 inch wide by 4 inch high block 60, the width (BW) exceeds the height (BH). One or more straps 78 may secure each block 60 to the cargo 20. Preferably the bottom side 61 defines a lateral groove 66 for accommodating the strap 78.

Rear Roller Unit 150

The rear roller unit 150 may be any suitable unit that allows controlled movement of the cargo 20 across a floor or other surface 25, such as the rear roller units 50 described above. Alternatively, referring again to FIG. 14, the rear roller unit 150 may comprise a wheel or roller 158 mounted to a frame 152 which in turn is connected to the underside 21 of the cargo 20.

III. Method of Moving Cargo

FIG. 15 is side elevational view of the core moving system 100 shown in the raised (moving) position. When the system 100 is tilted for moving purposes, the rear wheel or roller 158 engages the floor 25 while the frame 152 (as well as the blocks 60) are spaced apart from (elevated off) the floor 25. Alternatively, the wheel 158 may be slightly elevated off the floor 25 when the system 100 is in the stationary position but will contact the floor 25 when the system 100 is in the raised position.

Similarly, with respect to the preferred system 10, when the system 10 is tilted for moving purposes, the rear wheel or roller 58 engages the floor 25 while the frame 52 (as well as the pallets 80, 82) are spaced apart from (elevated off) the floor 25. Alternatively, the wheel 58 may be slightly elevated off the floor 25 when the system 10 is in the stationary position but will contact the floor 25 when the system 10 is in the raised position.

The embodiments of FIGS. 1 and 14 may be moved using a hauler 12. The hauler 12 may be any suitable machine, vehicle or apparatus that can tilt upward one end of a load and then move the load across a surface 25, such as by pulling, including a forklift truck and a pallet lifter. The hauler 12 may have a hitching element to which the cargo 20 is hitched or otherwise connected, such as forks 17 or a hitching ball.

For example, in FIG. 15, the system 100 of FIG. 14 is shown being moved by a forklift truck 12. The forklift truck 12 comprises an operator cab 14 and a pair of horizontally extending forks 17 mounted to a mast 18. The forks 17 are reciprocally moveable in a vertical direction between a lower position and a raised position.

The method of moving cargo may comprise the follow steps:

First, an operator of a forklift truck 12 engages the front engagement device 30, 130 by connecting the front engagement device 30, 130 to the forklift truck 12. For the preferred front engagement device 30, this connecting step may be accomplished by inserting the forks 17 into the channel members 42. For the alternative front engagement device 130, this connecting step may be accomplished by attaching the hitching bar 138 to the forklift truck 12.

Once the front engagement device 30, 130 is connected to the hauler 12, the operator raises the forks 17 to a raised position, which tilts the cargo 20 as shown in FIG. 15.

Finally, the operator can now move the cargo 20 to a desired location.

While in operation, when the hitching element 16 engages the front engagement device 30, 130 and is in the raised position, the cargo front end 26 may be elevated above the cargo rear end 28 and the blocks 60 and/or pallets 80, 82 are disengaged (spaced) from the floor 25, preferably a distance equal to or greater than half their height, which allows the bundled cores 22 to be rolled/wheeled around without being damaged.

INDUSTRIAL APPLICABILITY

The moving system allows for bundled cores to be easily moved or manipulated from the manufacturing floor to the loading docks. Furthermore, at the customer facility, the invention allows for the cores to be unloaded from trailers and stored in a warehouse before being moved to the production floor for use.

The moving system also minimizes the need for upfront capital. Furthermore, the new concept doesn't require return freight after every shipment, thus reducing total overall costs in the system. The new concept doesn't require a lot of real estate for storage, and as a result frees up space in the core manufacturing plant, and/or allows the core manufacturer to do away with trailer leases for storage on the yard. Finally, this concept may allow for increased payload in some cases which once again reduces overall system costs.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A system for moving cargo over a surface, the cargo having an underside, a front end, a rear end, a longitudinal cargo length (CL) and a cargo height (CH), the system comprising:

a hauler comprising an operator cab and a hitching element reciprocally moveable in a vertical direction between a lower position and a raised position;

a front engagement device affixed to the underside of the cargo and slightly rearward of the cargo front end, the front engagement device configured to be operably engaged to the hitching element;

a rear roller unit affixed to the underside of the cargo slightly forward of the cargo rear end to allow raising of the cargo front end, the rear roller unit comprises a rear frame and one or more rollers affixed to the rear frame; and one or more spaced apart pallets affixed in stationary relationship to the underside of the cargo;

wherein, when the hitching element engages the front engagement device and is in the lower position, each of the pallets contacts the surface; and when the hitching element engages the front engagement device and is in the raised position, the cargo front end is elevated above the cargo rear end, the pallets are spaced from the surface, and the one or more rollers are in rolling contact with the surface, thereby allowing the cargo to be easily moved.

2. The system of claim 1 wherein:

the cargo comprises multiple elongated cargo units bundled together in tight, staggered arrays of at least three layers and held together with straps.

3. The system of claim 2 wherein:

each cargo unit is a hollow cylindrical tube.

4. The system of claim 1 wherein:

each pallet defines openings extending laterally across a width of the pallet to accommodate the straps extending therethrough; and the straps extend over and around the cargo to secure the cargo to the pallet.

5. The system of claim 1 wherein:

one or more of the pallets includes a runner having a tapered front end and a tapered rear end to prevent the pallets from catching on or being jostled by irregularities on or part of the surface.

6. The system of claim 1 wherein:

the front engagement device is a U-shaped member defining a lateral channel for accommodating one or more straps.

7. The system of claim 1 wherein:

the front engagement device has a forward facing wall that defines an opening for accommodating a linkage system for connecting the front engagement device to the hauler.

8. The system of claim 7 wherein:

the hauler is a forklift truck having forks;

the front engagement device is connected to the forklift truck via a linkage system, the linkage system comprising a pair of channel members configured to receive the forks, a crossmember affixed to a distal end of each channel member in stationary relationship therewith, a hitch arm connected to the crossmember, and a hitching bar connected to the hitch arm; and the hitching bar extends rearwardly into the opening defined by in the front engagement device.

9. The system of claim 1 further comprising at least one cargo side support system, each cargo side support system comprising:

a U-shaped member defining a channel and having two ends;

a pair of hinges affixed to each U-shaped member end;

two cargo side supports, each cargo side support extending upwardly from an end of the U-shaped member to support a side of the cargo; and one or more straps extending through the channel, along an outer surface of each cargo side support and around the cargo.

10. A system for moving cargo over a surface, the cargo comprising multiple elongated cargo units bundled together with straps, the cargo having an underside, a front end, a rear end, a longitudinal cargo length (CL) and a cargo height (CH), the system comprising:

a hauler comprising an operator cab and a hitching element reciprocally moveable in a vertical direction between a lower position and a raised position;

a front engagement device affixed to the underside of the cargo and slightly rearward of the cargo front end, the front engagement device configured to be operably engaged to the hitching element;

a rear roller unit affixed to the underside of the cargo slightly forward of the cargo rear end to allow raising of the cargo front end, the rear roller unit comprising a rear frame and one or more rollers affixed to the rear frame; and one or more spaced apart blocks affixed in stationary relationship to the underside of the cargo and configured to contact the surface when the hitching element is in the lower position, each block having a height (BH) extending from the cargo underside to the surface when the when the hitching element is in the lower position;

wherein, when the hitching element engages the front engagement device and is in the lower position, each of the blocks contacts the surface; and when the hitching element engages the front engagement device and is in the raised position, the cargo front end is elevated above the cargo rear end, the blocks are disengaged (spaced) from the surface, the one or more rollers are in rolling contact with the surface, thereby allowing the cargo to be easily moved.

11. The system of claim 10 wherein:

the cargo comprises multiple elongated cargo units bundled together in tight, staggered arrays of at least three layers and held together with straps.

12. The system of claim 11 wherein:

each cargo unit is a hollow cylindrical tube.

13. The system of claim 10 wherein:

one or more of the blocks is an elongated rectilinear block-shaped structure.

14. The system of claim 10 wherein:

each block has a bottom, a top, a front side, a rear side and two lateral ends;

each block has a height (BH) equal to the distance from the underside of the cargo to the surface when the hitching element is in the lowered position;

each block has a height (BH) and a width (BW) that exceeds the height (BH); and the bottom side of each block defines a lateral groove for accommodating a strap.

15. The system of claim 10 wherein:

the front engagement device is a stand-alone unit and comprises a frame and a hitching bar extending from the frame forward of the cargo front end; and the hitching bar is operatively connected to the hauler.

16. A system for moving cargo over a surface, the cargo having an underside, a front end, a rear end, a longitudinal cargo length (CL) and a cargo height (CH), the system comprising:

a hauler (such as a forklift truck) comprising an operator cab and a hitching element reciprocally moveable in a vertical direction between a lower position and a raised position;

a front engagement device affixed to the underside of the cargo and slightly rearward of the cargo front end, the front engagement device configured to be operably engaged to the hitching element;

a rear roller unit affixed to the underside of the cargo slightly forward of the cargo rear end to allow raising of the cargo front end, the rear roller unit comprises a rear frame and one or more rollers affixed to the rear frame; and one or more spaced apart bottom supports affixed in stationary relationship to the underside of the cargo;

wherein, when the hitching element engages the front engagement device and is in the lower position, each of the bottom supports contacts the surface; and when the hitching element engages the front engagement device and is in the raised position, the cargo front end is elevated above the cargo rear end, the bottom supports are spaced from the surface, and the one or more rollers are in rolling contact with the surface, thereby allowing the cargo to be easily moved.

* * * * *